United States Patent [19]

Paley et al.

[11] Patent Number: 4,458,581

[45] Date of Patent: Jul. 10, 1984

[54] CONTROL DEVICE FOR FLUID ENERGY TRANSLATORS

[75] Inventors: Edward D. Paley, 7359 Deep Run, Apartment 410, Birmingham, Mich. 48010; Ranny J. Nunley, Ferndale, Mich.

[73] Assignee: Edward D. Paley, Birmingham, Mich.

[21] Appl. No.: 260,402

[22] Filed: May 4, 1981

[51] Int. Cl.[3] ..... F01B 13/04

[52] U.S. Cl. ..... 91/506

[58] Field of Search ..... 417/218–222, 417/213, 217; 91/504, 505, 506

[56] References Cited

U.S. PATENT DOCUMENTS

| | | | |
|---|---|---|---|
| 2,452,754 | 11/1948 | Herrstrum | 91/506 X |
| 3,371,483 | 3/1968 | Gray et al. | 91/506 X |
| 3,614,913 | 10/1971 | Clark . | |
| 3,786,728 | 1/1974 | Sheesley et al. . | |
| 3,803,987 | 4/1974 | Knapp | 91/506 |
| 3,908,518 | 9/1975 | Bobier | 91/506 |
| 4,094,231 | 6/1978 | Carr . | |
| 4,170,169 | 10/1979 | Shafer . | |
| 4,274,257 | 6/1981 | Koch et al. | 417/222 X |

FOREIGN PATENT DOCUMENTS

| | | | |
|---|---|---|---|
| 2347542 | 3/1975 | Fed. Rep. of Germany | 91/506 |
| 149399 | 7/1981 | Fed. Rep. of Germany | 91/506 |

*Primary Examiner*—Edward K. Look

*Attorney, Agent, or Firm*—Basile, Weintraub & Hanlon

[57] ABSTRACT

A control device for varying the displacement of variable volume fluid energy devices is disclosed. The control cylinder of the present invention is usable with variable volume pumps and motors having a control rod projecting from the pump housing and angular movement of the control rod varies the pump or motor displacement. The control cylinder includes a bore formed in the cylinder, a spool movable within the bore, a lever fixedly attached to the control rod for rotation therewith, a directional control valve manifold mounted to the cylinder for selectively moving the spool within the bore, and a scotch yoke for interconnecting the lever to the spool so that movement of the spool produces an angular movement of the control rod varying the pump displacement. The control device may also be directly applied to an apparatus requiring a linear input for control. A plurality of control devices may be combined to produce an analog input that is either angular or linear.

8 Claims, 6 Drawing Figures

CONTROL DEVICE FOR FLUID ENERGY TRANSLATORS

BACKGROUND OF THE INVENTION

I. Field of the Invention

The present invention generally relates to the field of controls for devices requiring considerable power to operate their controls and, in particular, the present invention is concerned with externally mounted controls for varying the volume of variable volume pumps having an externally projecting control rod that is rotatable to vary the pump displacement or volume.

II. Description of the Prior Art

Variable volume pumps having an externally attached cylinder for varying the pump displacement are known. Control cylinders for controlling variable volume pumps from the exterior of the pump comprise a conventional cylinder with a rod extending from an end thereof with an end of the rod engaging a lever associated with a rotatable control rod projecting from the pump. This type of control cylinder has serious drawbacks such as external leakage from the packing gland around the rod; unequal amounts of oil required to stroke the cylinder in opposed directions; leakage across the control cylinder piston affecting the accuracy and positioning of the control; and an inability of the control cylinder of this type to lend itself to an integrated package design with only a pressure and return line attached to the cylinder. Control devices having a rotary or angular output attachable to the rotatable control rod of a variable volume pump also are known. Devices of this type are also susceptible to malfunction caused by leakage across the cylinder piston, and are susceptible to failure due to leakage past a rotary seal on the output shaft. Examples of rotary operators in the prior art are disclosed in U.S. Pat. Nos. 3,614,913; 3,786,728; 4,094,231; and 4,170,169. These patents are relevant to the applicants' invention in that they represent the closest prior art for utilizing a piston operated by fluid under pressure to produce a rotary motion.

III. Prior Art Statement

The aforementioned prior art, in the opinion of the applicants' and the applicants' attorney, represents the closest prior art of which the applicants' and their attorney are aware.

SUMMARY OF THE INVENTION

The present invention, which will be described in detail hereinafter, comprises a control cylinder for varying the output of a device such as a hydraulic pump and includes a bore formed in the cylinder with a spool movable within the bore. A lever is fixedly attached to the control rod which extends from the pump housing and is rotatable to vary the pump displacement. The lever is rotatable with the control rod, and a control means associated with the cylinder selectively moves the spool within the bore. A connecting device comprising a scotch yoke is provided for interconnecting the lever and the spool so that spool movement produces an angular movement of the control rod to vary the pump displacement. Adjustable stops are provided at the ends of the control cylinder for varying the end position of the spool. A three position fourway valve is provided to selectively vary the position of the spool within the cylinder bore by applying fluid under pressure to one side of the spool while applying return pressure to another side of the spool moving the spool along the cylinder bore. A hole pattern is provided on the cylinder to manifold mount the four-way valve and provide internal conduits for interconnecting the ends of the spool with the fourway valve and interconnecting the pressure and return ports with the fourway valve. This minimizes the number of external connections required.

In an alternate embodiment, a proportional electro-servo valve may be used to port fluid to the ends of the spool in a controlled manner. By linking the electro-servo valve to an electronic circuit, control of the spool acceleration, deceleration, and rate of travel can be attained. The electrical circuit may also included: programmed response to circuit conditions including fluid pressure, temperature, pump speed, etc.

It is therefore a primary object of the present invention to provide a new and improved control cylinder for varying the pump displacement of a variable volume pump.

It is a further object of the present invention to provide such a control cylinder that is economical to build and reliable in its operation.

It is yet another object of the present invention to provide a control cylinder for variable volume pumps that requires only a fluid pressure and a return line connection to complete the hydraulic circuit.

It is a further object of the present invention to provide a control cylinder for variable volume pumps having replacable inside stops to permit either one side of center operation of the pump or over-center pump operation.

It is yet a further object of the present invention to provide a control cylinder for variable volume pumps that has adjustable stops permitting the maximum pump flow and the minimum pump flow or the reverse pump flow to be selectively varied.

It is another object of the present invention to provide a control cylinder for variable volume pumps wherein the control of the pump is not affected by leakage past the spool.

It is also an object of the present invention to provide a control cylinder for variable volume pumps that has a minimum of play and sloppiness in the control linkage.

It is yet a further object of the present invention to provide a control cylinder for variable volume pumps wherein equal area is provided for movement of the control in either direction for simplified uniform control in either direction.

It is another object of the present invention to provide a manual override for the control cylinder permitting manual operation and control of the pump volume.

It is yet another object of the present invention to provide a spring centered control cylinder for variable volume pumps that permits automatic centering of the pump in the event of a control failure.

It is a further object of the present invention to provide a control cylinder for variable volume pumps having cartridge type flow controls in the lines between the spool ends and the four-way valve to control the rate at which the pump changes displacement.

It is also an object of the present invention to provide a control device for variable volume fluid devices which responds in proportion to an electrical signal provided to a servo or proportional control valve.

Further objects, advantages and applications of the present invention will become apparent to those skilled in the art of variable volume pump controls when one example of the best mode contemplated for practicing the invention is read in conjunction with the accompanying drawings.

BRIEF DESCRIPTION OF THE DRAWING

In the drawing like numbers refer to like parts throughout the several views and wherein.

DESCRIPTION OF THE PREFERRED EMBODIMENT

Figures 1, 6:
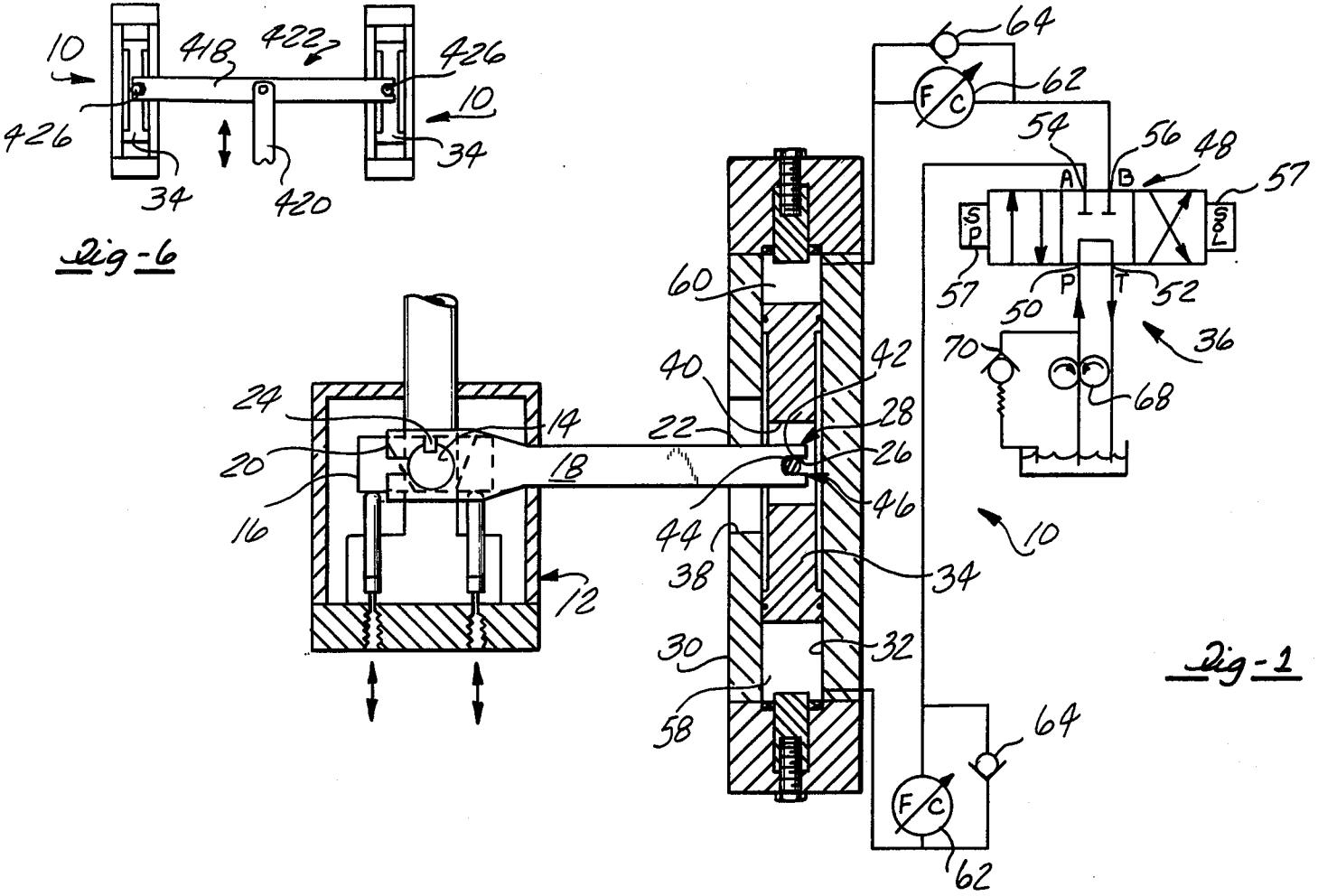
FIG. 1 is a schematic diagram of a preferred embodiment of the control cylinder of the present invention.
FIG. 6 illustrates a schematic view of a pair of control devices combined to produce an analog output.

Referring now to the drawing, there is illustrated in FIG. 1 one example of the present invention in the form of a control cylinder 10 for a variable volume pump 12. The variable volume pump 12 includes a control rod 14 projecting from the pump housing for varying the pump displacement. The control rod 14 is attached to a swash block or yoke 16 and rotation of the control rod varies the angle of the swash block relative to the pump axis to alter the amount of fluid pumped per revolution of the pump in proportion to the swash block angle. Generally, the swash block angle may be varied either side of a right angle with the pump axis, with a swash block angle on one side of the pump axis inducing fluid flow in one direction, and a swash block angle on another side of the pump axis inducing fluid flow in an opposed direction. A lever 18 is attached to the control rod 14 and is rotatable therewith, with the lever 14 including a control rod end 20 and a cylinder end 22. The control rod end 20 is affixed to the control rod 14 by means of a key 24 to securely affix the lever 18 to the control rod 14 for rotation therewith. A slot 26 is formed along the cylinder end 22 of the lever to define a fork 28. The control cylinder 10 further includes a cylinder housing 30 with a longitudinal bore 32 formed therein to slidingly support a spool 34 movable along the bore 32. A control means 36 is provided to selectively move the spool 34 in the bore 32 and angularly position the control rod 14 in a manner which will be described in greater detail subsequently.

The control cylinder housing 30 includes a first longitudinal slot 38 centrally located along the bore 32 and in communication therewith to receive the cylinder end 22 of the lever 18. A central slot 40 is formed in the spool aligned with the first longitudinal slot 38, and a pair of aligned apertures 42 intersect the central slot 40. A pin 44 snugly engages the aligned apertures and extends across the central slot 40 and slidingly engages the fork 28 to form a scotch yoke 46 wherein movement of the spool 34 in the bore 32 causes a corresponding angular movement of the lever 18 and the control rod 14.

Figure 2:
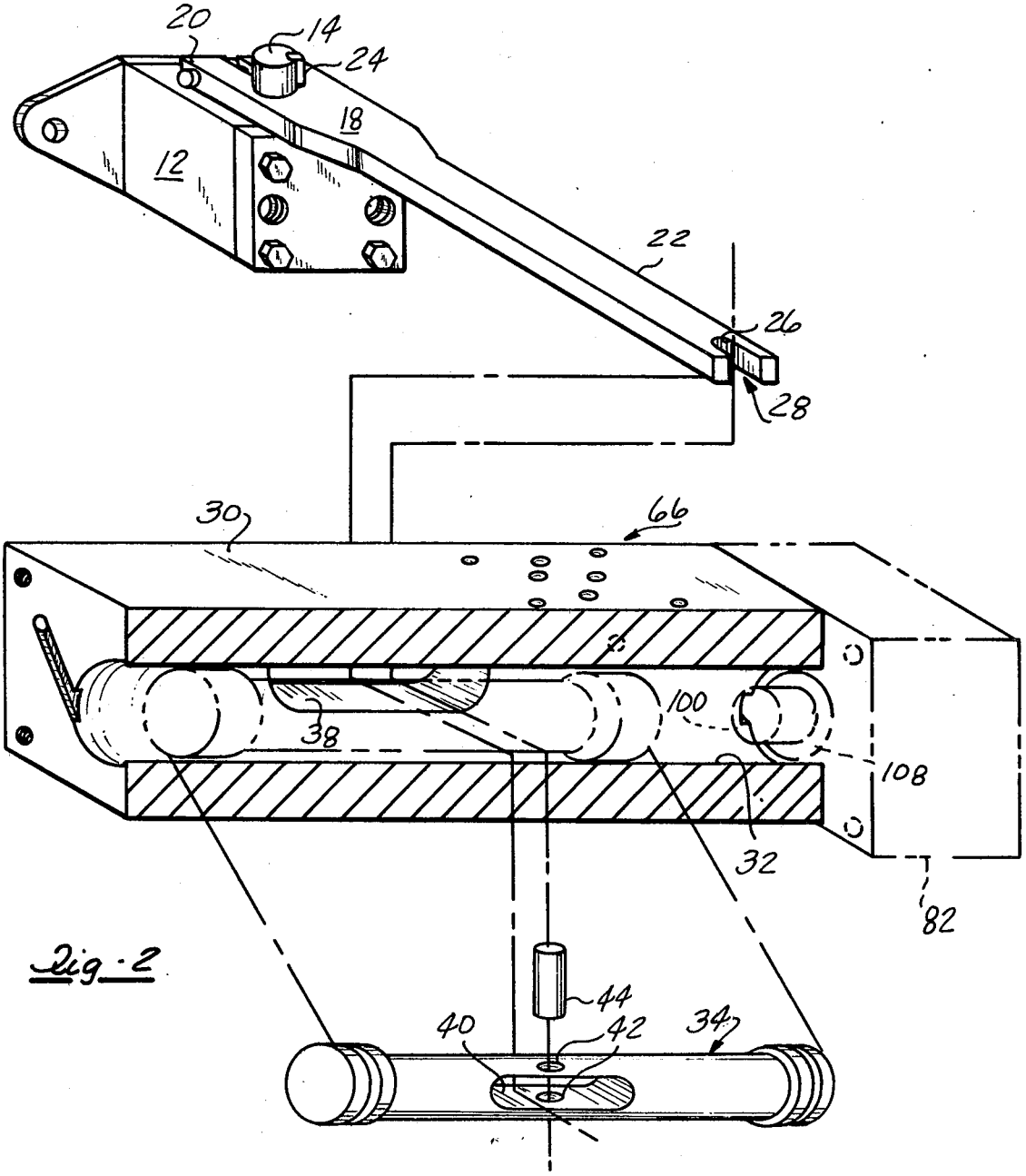
FIG. 2 illustrates a broken, perspective exploded view of the control cylinder for the present invention.
Figure 3:
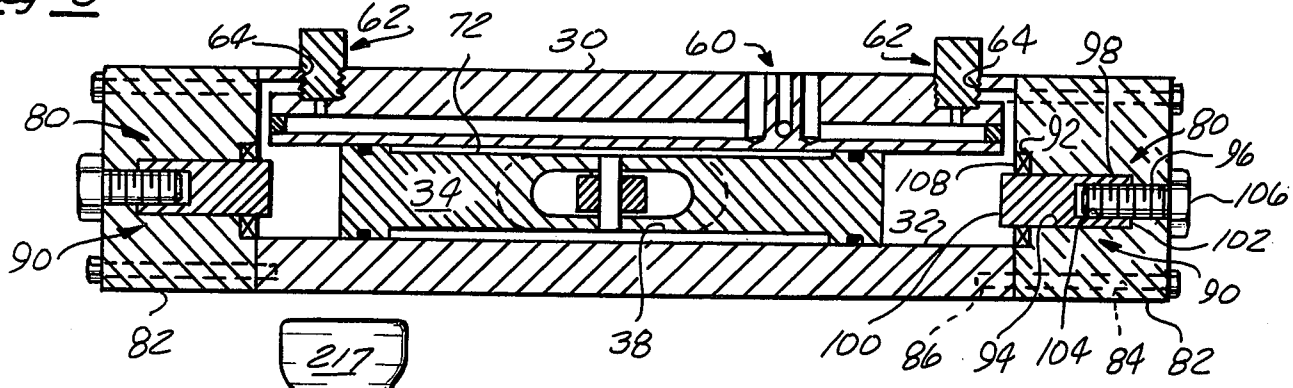
FIG. 3 illustrates a cross-sectional view of the control cylinder shown in FIG. 2 of the drawing taken along the spool axis.

As can best be shown in FIG. 1 of the drawing, the control means 36 for selectively moving the spool 34 along the bore 32 comprises a three position four-way directional control valve 48 having a pressure port "P" 50, a return port "T" 52, a one cylinder port "A", 54, and another cylinder port "B", 56, with the one cylinder port 54 connected to a one spool end chamber 58 and another cylinder port 56 interconnected to another spool end chamber 60. When the four-way valve 48 is in a first position, pressure is applied to one cylinder port 54 and return pressure is applied to another cylinder port 56 to urge the spool 34 in a first direction. When the four-way valve 48 is in a second position, pressure is applied to another cylinder port 56 and return pressure is applied to one cylinder port 54 to urge the spool 34 in a second direction. In a preferred embodiment as shown in FIG. 1 of the drawing, the four-way valve 48 is spring centered to a neutral position where the ports 54, 56 are blocked and the pressure and return ports are interconnected. Solenoids 57 are selectively energized to shift the valve 48 to the first or second positions. Optionally, a flow control valve 62 is interposed in the line between the one cylinder port 54 and the one spool end chamber 58 and between the other cylinder port 56 and another spool end chamber 60 to control the rate at which the spool 34 moves from one position in the bore 32 to another position in the bore. Preferably the flow controls 62 are adjustable so that optimum control can be achieved with a minimum shock to the system. Check valves 64 are provided to allow free flow bypassing the flow control valves 62 in one direction of flow allowing the flow control to function in only one direction. As shown in FIG. 3 of the drawing, the flow controls 62 are of the cartridge type and are inserted into bores 64 formed in the cylinder housing 30. As shown in FIG. 2 of the drawing, the cylinder housing 30 includes a hole pattern 66 having an arrangement of bores complimentary to the fourway valve 48 so that the fourway valve can be directly mounted to the cylinder with the various valve ports automatically interconnected to the various passages formed in the cylinder housing 30. This eliminates the need for external lines and hoses other than a pressure line to the cylinder housing 30 and a return line from the cylinder housing 30 to complete the hydraulic circuit.

It is apparant to the skilled artisan that the operation of the valve 48 shown in FIG. 1 can be accomplished using a microprocessor to selectively energize the solenoids 57. The microprocessor in turn can be linked to a computer and full computer control of the device can be established. A rotary potentiometer linked to the rod 14 can be used to establish position feed back to the microprocessor thereby establishing closed loop control.

Fluid pressure for control of the cylinder 10 may be derived in a variety of ways. A separate control pump 68 as shown in FIG. 1 may be utilized to draw oil from the hydraulic reservoir and supply control oil to the port 50 with a relief valve 70 to maintain control pressure and return excess oil to the reservoir. The control pump 68 may be independently driven by an electric motor or may be mechanically coupled to the variable volume pump 12. Alternately, shop air may be used to operate the control cylinder 10.

The control cylinder 10 optionally includes a means 80, as illustrated in FIG. 3 of the drawing, for selectively varying the spool end position. The means 80 comprises the control cylinder 10 including open ends with a pair of end caps 82 to enclose the cylinder ends. A plurality of apertures 84 are formed in the end caps 82 aligned with a plurality of threaded apertures 86 formed in the cylinder housing 30 with a plurality of threaded fasteners 88 engaging the threaded apertures 86 to securely fasten the end caps 82 to the cylinder housing 30. Each end cap 82 includes a central step bore 90 aligned with the axis of the bore 32 and extending through the end cap. The step bore 90 includes a large inner bore 92, an intermediate bore 94, and an outer bore 96 smaller than the intermediate bore with a shoulder 98 provided between the intermediate and outer bores. A stop pin 100 slidingly engages the intermediate bore 94 with an end 102 abutting the shoulder 98. The length of the stop pin 100 is selected to project into the bore 32 and abut the spool 34 to establish the end position of the spool. The stop pin 100 includes a threaded central bore 104 and a threaded fastener 106 threadingly engaging the threaded central bore to secure the stop pin to the cover 82. A shaft seal 108 snugly engages the inner bore 92 and the pin 100 to prevent external leakage of fluid past the stop pin 100. The stop pin design illustrated in FIG. 3 discourages tampering with the stops by inexperienced personnel because removal of the end cap 82 and the insertion of a longer or shorter pin 100 is required to alter the spool end position.

The spool 34 includes a reduced diameter 72 at the central portion thereof to relieve pressure in the central portion of the spool and provides free communication between the central portion of the spool and the first longitudinal slot 38. This allows any leakage that might occur between the spool ends and the central portion of the spool to be dispatched overboard and avoids any leakage that might occur interfering with the control function by having the leakage go across the spool into the opposing end of the spool.

Figure 4:
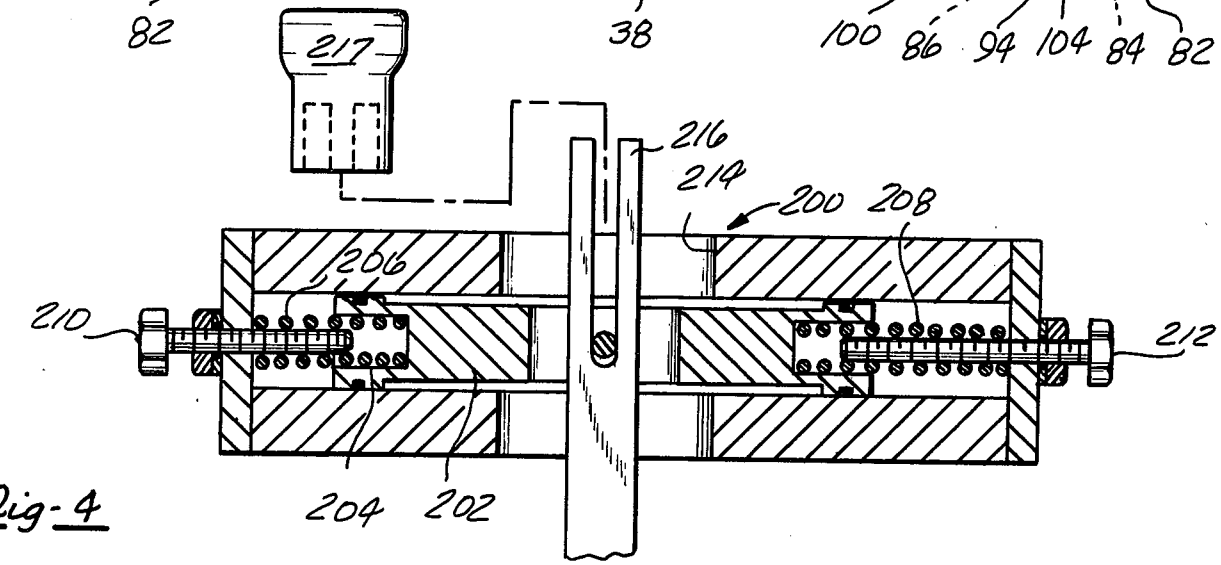
FIG. 4 illustrates a cross-sectional view of an alternate embodiment of the present invention having a manual override and spring centered spool.

FIG. 4 of the drawing illustrates at 200 an alternate embodiment of the control cylinder. An alternate spool 202 includes recessed ends 204 to accommodate a pair of centering springs 206, 208. The centering springs 206, 208 establish the pump control rod 14 in a neutral position when the pump is at rest and there is no biasing pressure within the control system. FIG. 4 also illustrates alternate adjustable stops 210, 212 which are readily and externally adjustable. However, the means for selectively varying the spool end position illustrated in FIG. 3 is preferable since it discourages the machine operator from tampering with the stop setting. A second longitudinal slot 214 formed in the cylinder 200 allows an extension of the lever 216 through the cylinder. It can be readily seen by the skilled observer that the operator of the machine may readily grasp the extending end of the lever 216 and manually position the spool, thereby establishing manual control of the pump. A handle 217 is provided at the end of the lever 216 to aid in the manual manipulation of the lever. Fluid control of the pump is achieved in the same manner as described hereinabove utilizing the four-way valve 48.

Figure 5:
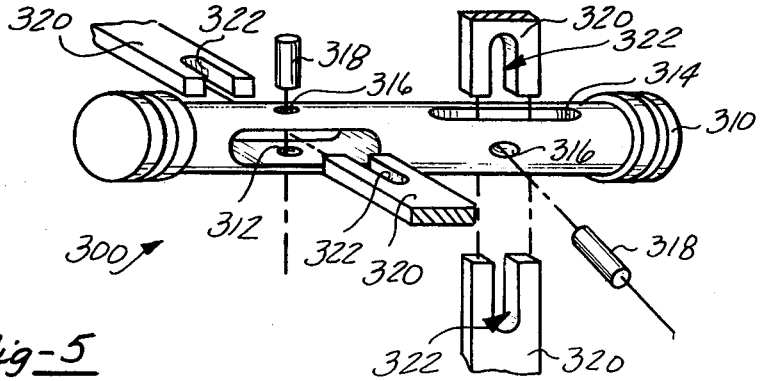
FIG. 5 illustrates a broken, perspective exploded view of an alternate spool configuration for simultaneous control of a plurality of control rods.

Referring now to FIG. 5 of the drawing, there is illustrated a broken, perspective view of an alternate embodiment of the spool at 300. This alternate embodiment includes a spool 310 having a pair of spaced apart slots 312, 314 oriented at right angles to each other. Each of the slots, 312, 314 include an aperture 316 extending across the slot to snugly receive a pin 318. Each pin 318 is configured to slidingly receive a pair of slotted levers 320 having slotted ends 322 to straddle the pin 318 for movement therewith. Each slotted lever 320 has a thickness less than one-half the thickness of the spaced slots 312, 314 so that a pair of slotted levers 320 may simultaneously engage a single pin 318 from opposite sides with the levers slidingly stacked one upon another. The pin 318, the slot 322, and the slotted lever 320, define a scotch yoke for converting linear movement of the spool 310 into angular movement of the lever 320. It is apparent to the skilled artisan that the device shown in FIG. 5 of the drawing allows simultaneous angular movement of four slotted levers 320 with the linear movement of the spool 310.

As illustrated in FIG. 6 of the drawing, two or more control devices 10 may be combined to produce an analog output representing the combined movement of the pistons 34. A whiffletree mechanism 422 is utilized comprising a beam 418 including a pair of slots 426 formed at the ends thereof. The slots 418 slidingly straddle pins 44, and a control beam 420 pivotally connected to beam 418 responds to the combined movement of the control devices 10.

It can thus be seen that the present invention has provided a new and improved control cylinder for variable volume pumps that can be easily and inexpensively applied to pumps having a control rod projecting therefrom which, when rotated, varies the pump displacement. It is readily apparent to the skilled artisan that the present invention provides an economical and easily used method for achieving pump control that is reliable in operation and can be applied to a hydraulic pump with a minimum of backlash and control sloppiness. It is also apparent that due to the elimination of numerous hydraulic lines and fittings, installation costs and the possibility of hydraulic leaks is minimized.

It should be understood by those skilled in the art of controls for variable volume pumps that other forms of the applicants' invention may be had, including the use of an electro-servo valve to selectively move the spool 34, all coming within the spirit of the invention and the scope of the appended claims.

Having thus described our invention, what we claim is:

1. In a variable volume pump of the type including a housing to enclose the pump, and including a control rod projecting from the pump housing wherein angular movement of the rod varies the pump displacement, the improvement comprising:

a control cylinder for varying the pump displacement comprising a bore formed in said cylinder, a spool movable in said bore, a lever fixedly attached to the control rod and rotatable therewith, control means associated with said cylinder for selectively moving said spool in said bore, connecting means for interconnecting said lever and said spool so that spool movement produces an angular movement of the control rod to vary the pump displacement;

means for selectively varying the end position of said spool comprising;

said control cylinder including open ends with a pair of end caps to enclose the ends, a plurality of apertures formed in the end caps aligned with a plurality of threaded apertures in the cylinder ends, a plurality of threaded fasteners threadingly engaging the threaded aperatures to secure the end caps to the cylinder;

each end cap including a central step bore aligned with the bore axis of said cylinder extending through the end cap; said step bore including a large inner bore, an intermediate bore, an outer bore smaller than said intermediate bore with a shoulder between said intermediate and outer bores;

a stop pin slidingly engaging said intermediate bore and abutting said shoulder, the length of said stop pin selected to project into said cylinder and abut said spool to establish an end position of said spool, said pin including a threaded central bore, a threaded fastener engaging said outer bore to secure said stop pin to said cover; and a shaft seal snugly engaging said large inner bore and said stop pin to prevent fluid leakage from said cyliner.

2. The control cylinder defined in claim 1 wherein the control means for selectively moving said spool in said bore comprises:

a three position four-way directional control valve including a pressure port, a return port, and a pair of cylinder ports, one cylinder port connected to one spool end, another cylinder port connected to another spool end, and wherein when the four-way valve is in a center position the cylinder ports are closed and the pressure port and return port are interconnected, when the four-way valve is in a first position pressure is applied to the one cylinder port and return is applied to another cylinder port to urge said spool in a first direction, when the four-way valve is in a second position pressure is applied to another cylinder port and return is applied to one cylinder port to urge said spool in a second direction.

3. The control cylinder defined in claim 2 wherein the three position four-way directional control valve is manifold mounted on said control cylinder and said control cylinder contains internal passages for directing fluid flow to and from said four-way valve.

4. The control cylinder defined in claim 2 further comprising a first flow control interposed in an internal passage between the four-way valve one cylinder port and said one spool end, and a second flow control interposed in an internal passage between the four-way valve, another cylinder port and said another spool end.

5. The control cylinder defined in claim 4 further comprising said first and second flow controls controlling flow when fluid flow from the four-way valve is in a first direction, and permitting a free flow of fluid around said flow controls when fluid flow is in a second direction.

6. The control cylinder defined in claim 1 wherein the control means comprises an electro-servo valve for proportionately and selectively moving said spool in said bore, said spool responding proportionately to the level of electrical signal provided the electro-servo valve.

7. The control cylinder defined in claim 1 further comprising a biasing means for centering said spool in a predetermined position.

8. In a variable volume pump of the type including a housing to enclose the pump, and including a control rod projecting from the pump housing wherein angular movement of the rod varies the pump displacement, the improvement comprising:

a control cylinder for varying the pump displacement comprising a bore formed in said cylinder, a spool movable in said bore, a lever fixedly attached to the control rod and rotatable therewith, control means associated with said cylinder for selectively moving said spool in said bore, connecting means for interconnecting said lever and said spool so that spool movement produces an angular movement of the control rod to vary the pump displacement, said connecting means comprising, said lever including a control rod end and a cylinder end with a slot formed in said lever cylinder end defining a fork;

at least one longitudinal slot formed centrally in a wall of said cylinder communicating with said bore;

a central slot formed in said spool aligned with each said longitudinal slot;

a pair of aligned apertures intersecting said central slot with a pin snugly engaging the aligned apertures and extending across said central slot; and said cylinder end entering said longitudinal slot with said fork slidingly straddling said pin to form a scotch yoke wherein movement of said spool in said bore causes a corresponding angular movement of said lever and the control rod;

said control cylinder further including a manual override means for manually positioning said lever comprising;

a second longitudinal slot formed in said cylinder aligned with said first longitudinal slot;

said fork projecting through said second longitudinal slot; and wherein the projecting portion of said fork is manually movable.

* * * * *